US011045687B1

(12) United States Patent
Salomone

(10) Patent No.: US 11,045,687 B1
(45) Date of Patent: Jun. 29, 2021

(54) ADAPTABLE EXERCISE SYSTEM AND METHOD OF USE

(71) Applicant: Anthony Salomone, Odessa, FL (US)

(72) Inventor: Anthony Salomone, Odessa, FL (US)

( * ) Notice: Subject to any disclaimer, the term of this patent is extended or adjusted under 35 U.S.C. 154(b) by 21 days.

(21) Appl. No.: 16/362,213

(22) Filed: Mar. 22, 2019

Related U.S. Application Data

(60) Provisional application No. 62/751,751, filed on Oct. 29, 2018, provisional application No. 29/612,411, filed on Nov. 28, 2018.

(51) Int. Cl.
*A63B 23/12* (2006.01)
*A63B 21/00* (2006.01)
*A63B 21/068* (2006.01)

(52) U.S. Cl.
CPC .... *A63B 23/1218* (2013.01); *A63B 21/00047* (2013.01); *A63B 21/068* (2013.01); *A63B 2225/09* (2013.01)

(58) Field of Classification Search
CPC .. A61B 1/00; A61B 1/005; A61B 1/04; A61B 17/00; A61B 17/02; A61B 17/04; A61B 19/04; A61B 2009/006; A61B 2022/0028; A61B 2022/003; A61B 2022/0033; A61B 2022/0035; A61B 2022/0038; A61B 2022/0041; A61B 2022/043; A61B 2022/0092; A61B 2022/0094; A61B 2023/003; A61B 2023/006; A61B 21/0072; A61B 21/00178; A61B 21/0023; A61B 22/0002; A61B 22/0005; A61B 22/0007; A61B 22/001; A61B 22/02; A61B 22/0207; A61B 22/0214; A61B 22/0021; A61B 22/0228; A61B 22/0235; A61B 22/0285; A61B 22/0292; A61B 23/00; A61B 23/02; A61B 23/025; A61B 23/035; A61B 3/00; A61B 31/00; A61B 35/00; A61B 4/00; A61B 5/02; A61B 59/00; A61B 60/00
See application file for complete search history.

(56) References Cited

U.S. PATENT DOCUMENTS

| | | | | | |
|---|---|---|---|---|---|
| 1,410,149 | A * | 3/1922 | Williams | A63B 1/00 | 482/38 |
| 5,611,763 | A * | 3/1997 | Lochbaum | A63B 21/0084 | 482/111 |
| 5,919,118 | A * | 7/1999 | Stearns | A63B 22/001 | 482/51 |
| 8,079,915 | B2 * | 12/2011 | Spencer | A63G 9/00 | 472/118 |
| 9,675,829 | B1 * | 6/2017 | Katz | F16B 7/10 | |
| 10,814,160 | B2 * | 10/2020 | Liao | A63B 21/225 | |
| 2015/0202488 | A1 * | 7/2015 | Lo | A63B 22/001 | 482/52 |
| 2017/0072260 | A1 * | 3/2017 | Jackson | A63B 23/1218 | |

* cited by examiner

*Primary Examiner* — Nyca T Nguyen
*Assistant Examiner* — Andrew M Kobylarz
(74) *Attorney, Agent, or Firm* — Chris Tanner; TannerPatent.com

(57) ABSTRACT

An adaptable exercise system enables the portable and adaptable placement of exercise equipment that can be adjusted to suit the intended exercises to be performed. The system provides a cross bar and legs that can be used in water, sand, gravel, sod or any location. The legs are height adjustable and allow for a variety of configuration and thus exercises.

13 Claims, 5 Drawing Sheets

ADAPTABLE EXERCISE SYSTEM AND METHOD OF USE

BACKGROUND

1. Field of the Invention

The present invention relates generally to exercise equipment systems, and more specifically, to tools or systems that facilitate body movement.

2. Description of Related Art

Exercise equipment systems are well known in the art and are effective means to augment the use of muscles or other members of a body for the purpose of development, strengthening or conditioning. Common fixed equipment such as a raised bar is used to enable pull-ups. Other types of equipment such as rails, steps or the like are also used to enable particular movements or actions thereon.

One of the problems commonly associated with common exercise equipment systems is their use efficiency. For example, the equipment must be fixed in place or secured to other structure limiting their use to that place or an accommodating location.

Accordingly, although great strides have been made in the area of exercise equipment system, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
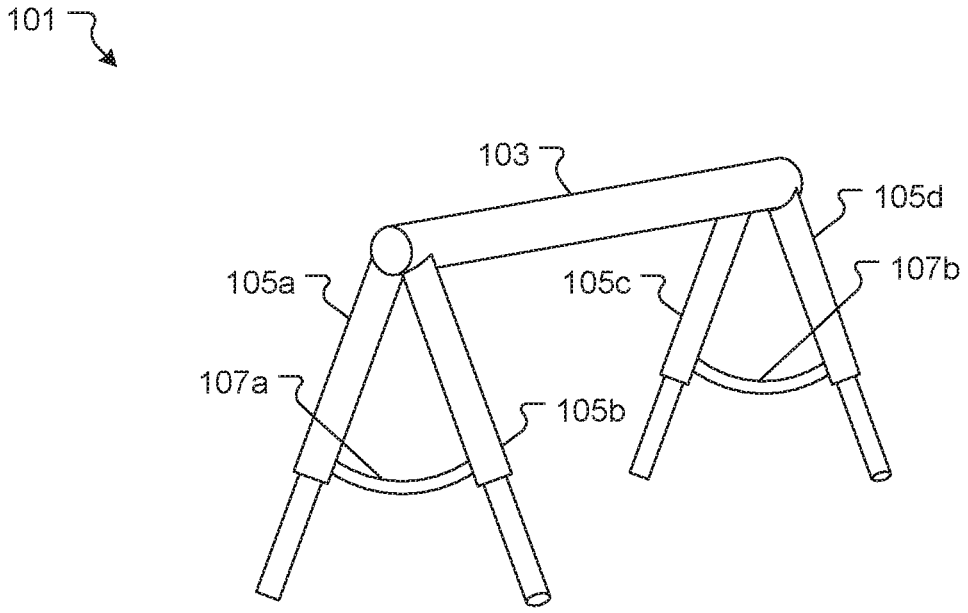
FIG. 1 is a perspective view of an adaptable exercise system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise equipment systems. Specifically, the invention of the present application enables the performance of equipment aided exercises in most any location. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a perspective view of an adaptable exercise system in accordance with a preferred embodiment of the present application. It will be appreciated that system 101 overcomes one or more of the above-listed problems commonly associated with conventional exercise equipment systems.

In the contemplated embodiment, system 101 includes a cross bar 103 supported by legs 105. The legs are pivotally attached in pairs at either end of the cross bar 103. The legs 105 are joined as pairs by bands 107 the bands are intended to stabilize the legs, it is contemplated that this could be done by other devices or the like. In the preferred embodiment the height of the cross bar with respect to the ground is four feet to 8 feet. The preferred width is fifty-four inches. These sizes are given as examples and not intended to limit the scope of this disclosure.

Figure 2A:
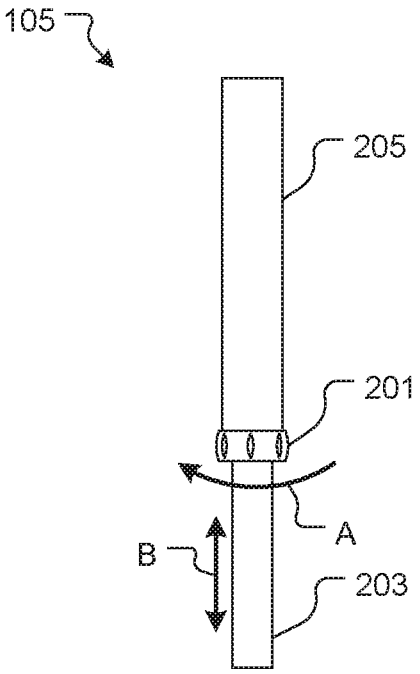
FIGS. 2A and 2B are front views of the legs of FIG. 1.
Figure 2B:
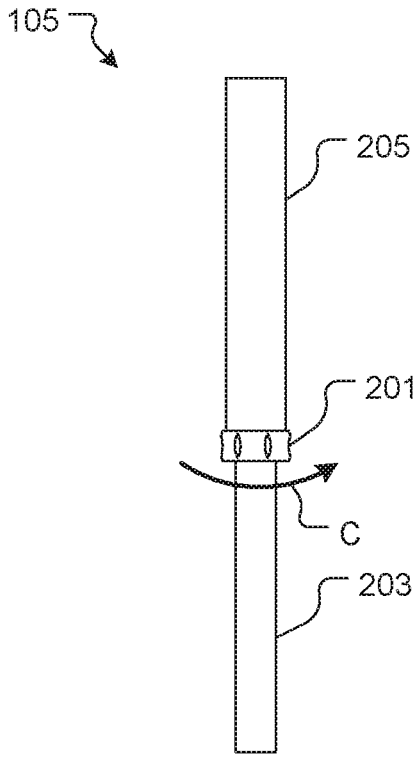

As depicted in FIGS. 2A and 2B the legs 105 are contemplated to be extendable via clamping device 201. The clamping device 201 is rotated as depicted by motion A allowing the lower leg 203 to extend away from the upper leg 205 as depicted by 6 motion B. The clamping device is then rotated as depicted by motion C to secure the lower leg in place with respect to the upper leg 205. Each leg 105 is able to be adjusted to accommodate uneven surfaces or to alter the position and height of the cross bar.

It should be appreciated that one of the unique features believed characteristic of the present application is that the legs 105 enable many configurations of the system 101 and also enable the system to be prepared and placed where it is needed. Examples of the use of the system and its versatility are given.

Figure 3A:
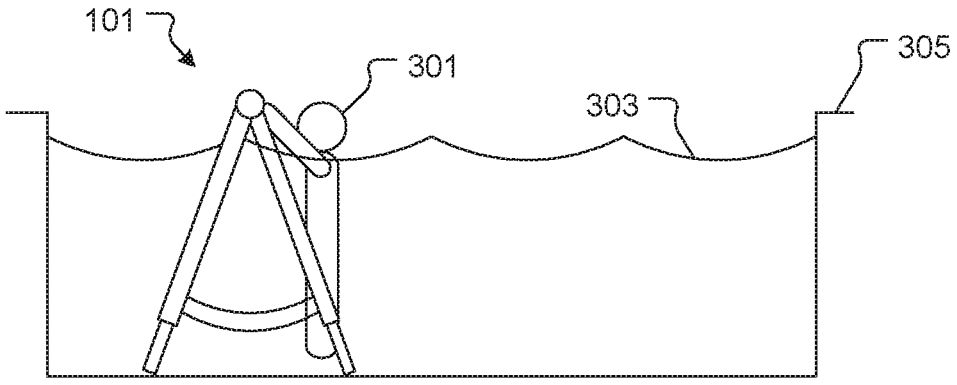
FIGS. 3A and 3B are side views of the system of FIG. 1 in use.
Figure 3B:
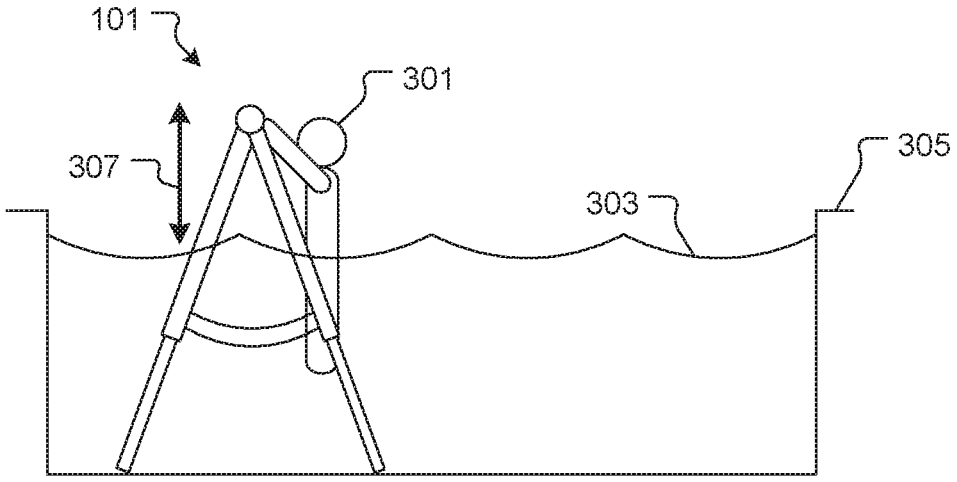

Referring now to FIGS. 3A and 3B the system 101 is placed in a pool 305 holding a body of water 303. The cross bar 103 is located just above the water 303 level and a user 301 pulls themselves toward the cross bar 103 by holding thereto. When the cross bar is raised distance 307 out of the water 303 the user 301 must now exert force to pull themselves from the water 303.

It will be understood and appreciated that the effort to lift a buoyant body in the water is less than out of the water. It will be further appreciated that in this manner the exercises performed with the system 101 enable the adaptation to the user 301 or other users of different strength or skill.

Figure 4:
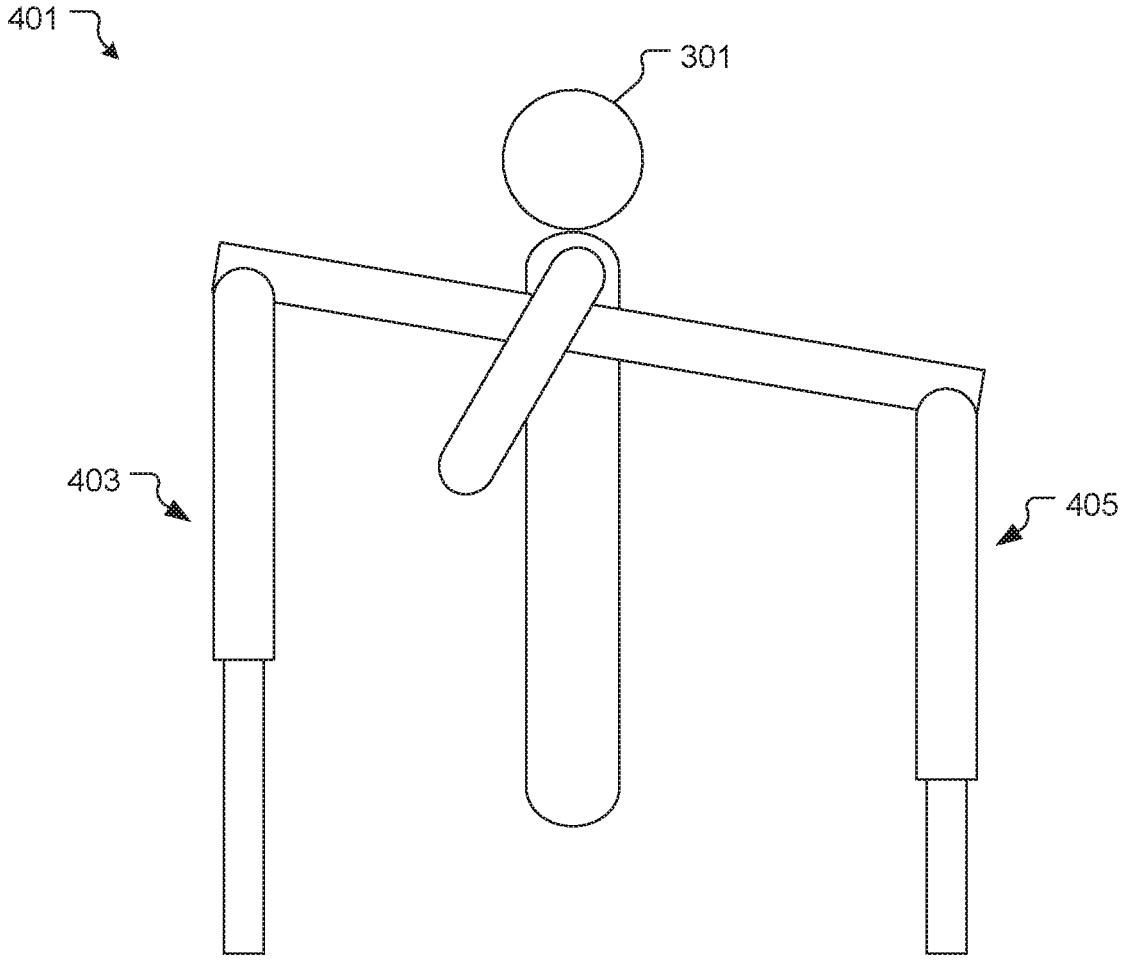
FIG. 4 is a front view of the system of FIG. 1 in an alternative method of use.

An alternative method of use for system 101 is depicted by FIG. 4 where legs 105 are adjusted to a height 403 on one side and height 405 on another. It will be understood that by so arranging the legs the cross bar 103 is no longer parallel to the ground and enables other movements by the user 301.

Figure 5:
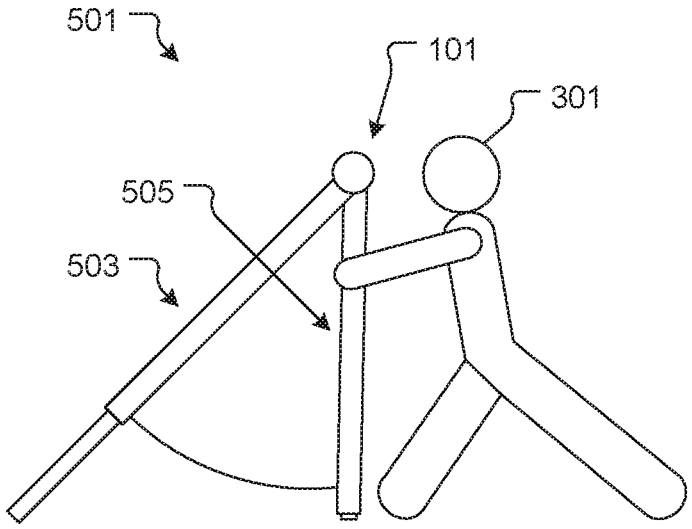
FIG. 5 is a side view of the system of FIG. 1 in an alternative method of use.

Another alternative embodiment for the use of system 101 is depicted by FIG. 5. In this embodiment 501, legs 103 are adjusted so that the foremost legs 103 are perpendicular to the ground by setting them to height 505 and the rear legs 103 to height 503. In this configuration the user 301 is able to push against the foremost legs 103 or the cross bar 103.

While these methods of use have been presented as examples of the use of system 101 others are contemplated. These that have been depicted are given as examples and not to limit the use of the system 101.

Figure 6:
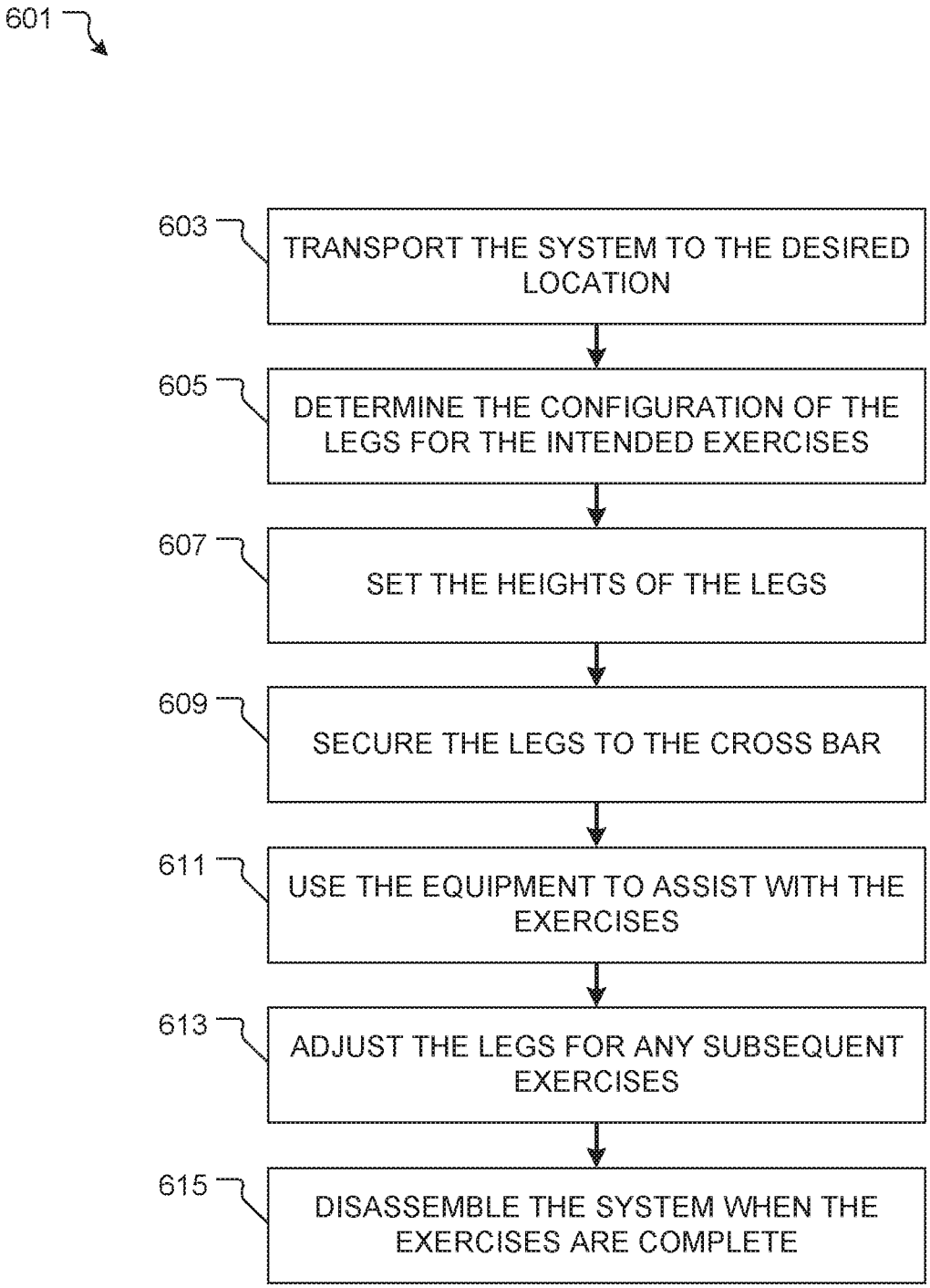
FIG. 6 is a flowchart of the preferred method of use of the system of FIG. 1.

Referring not to FIG. 6 the preferred method of use of system 101 is depicted. Method 601 includes transporting the system to the desired location 603, determining the configuration of the legs for the intended exercises 605, setting the heights of the legs 607, securing the legs to the cross bar 609, using the equipment to assist with exercises 611, adjusting the legs for a subsequent exercise 613 and disassembling the system when the exercises are complete 615.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A method of configuring and installing a water-based exercise system, comprising:

pivotally attaching a first pair of legs;

pivotally attaching a second pair of legs;

transporting the first and second pairs of legs to a predetermined water-based location;

determining a first configuration of each of the first and second pairs of legs by loosening one of a plurality of clamping devices where one clamping device is attached to each leg;

setting separate heights of each of the four legs according to the first configuration by fitting each of the four legs to an underwater ground-base and then tightening each of the corresponding clamping devices;

securing a crossbar to first and second pair of legs in the first configuration;

locating the crossbar a predetermined distance out of the water-based location suitable for pull-up exercising;

a user exerting a first upward force to pull themselves up from the water;

a threshold first upward force sufficient to raise the user out of the water being reduced due to upward-directed assistance from a natural buoyance of a body in water; and the user successfully pulling themselves part-way out of the water.

2. The method of claim 1, further comprising:

wherein the plurality of legs are of adjustable length via the plurality of clamping devices, wherein the plurality of clamping devices are suitable for use in water-environments.

3. The method of claim 2, further comprising:

achieving the step of loosening the clamping device by rotating the clamping device in a first rotary direction; and achieving the step of tightening the clamping device by rotating the clamping device in a second rotary direction.

4. The method of claim 1, further comprising:

adjusting legs to a first height on a first end of the crossbar and second height on a second end of the crossbar;

in so doing the legs, locating the crossbar to be non-parallel to the ground; and facilitating asymmetrical exercises for the user.

5. The method of claim 4, the step of adjusting further comprising:

during the step of adjusting, moving a lower leg away from or toward an upper leg along a first linear path.

6. The method of claim 1, further comprising:

configuring the crossbar to be parallel with a surface of the predetermined water-based location.

7. The method of claim 1, further comprising:

configuring the crossbar to be non-parallel with a surface of the water-based location.

8. The method of claim 1, further comprising:

attaching at least one leg band to the first pair of legs, thereby increasing stability of the system.

9. The method of claim 1, the step of adjusting further comprising:

separately adjusting each of the four legs to accommodate uneven underwater surfaces.

10. The method of claim 1, further comprising:

configuring a height of the crossbar according to a type of exercise or activity desired.

11. The method of claim 1, further comprising:

locating the crossbar just above the water such that the user pulling themself toward and away from the crossbar while holding thereto; and the user achieving upper body exercising in a mild way utilizing a natural buoyancy of a body in water thereby achieving exercise activity yet doing so while reducing strain on joints.

12. The method of claim 1, further comprising:

the system being adaptable to the users of different strength, skill, and/or body buoyancy.

13. The method of claim 1, further comprising:

locating the crossbar above the user's head and above the water.

* * * * *